US009005519B2

(12) United States Patent
Chen et al.

(10) Patent No.: US 9,005,519 B2
(45) Date of Patent: Apr. 14, 2015

(54) POWDER METALLURGICAL MATERIAL, PRODUCTION METHOD AND APPLICATION THEREOF

(75) Inventors: Hongqi Chen, Shanghai (CN); Jingtao Fei, Shanghai (CN)

(73) Assignee: Shanghai Xingluo Special Seals Co., Ltd., Shanghai (CN)

( * ) Notice: Subject to any disclaimer, the term of this patent is extended or adjusted under 35 U.S.C. 154(b) by 273 days.

(21) Appl. No.: 13/379,729

(22) PCT Filed: Jun. 22, 2010

(86) PCT No.: PCT/CN2010/000908

§ 371 (c)(1), (2), (4) Date: Mar. 9, 2012

(87) PCT Pub. No.: WO2010/148639

PCT Pub. Date: Dec. 29, 2010

(65) Prior Publication Data

US 2012/0156082 A1 Jun. 21, 2012

(30) Foreign Application Priority Data

Jun. 22, 2009 (CN) ..... 2009 1 0053554

(51) Int. Cl.

| | |
|---|---|
| ***B22F 3/12*** | (2006.01) |
| ***C22C 33/02*** | (2006.01) |
| ***B22F 3/10*** | (2006.01) |
| *B22F 1/00* | (2006.01) |
| *B22F 3/02* | (2006.01) |

(52) U.S. Cl.

CPC ..... *C22C 33/0214* (2013.01); *B22F 3/1021* (2013.01); *C22C 33/0285* (2013.01); *B22F 2003/023* (2013.01); *B22F 2998/00* (2013.01)

(58) Field of Classification Search

USPC ..... 419/10; 75/252

See application file for complete search history.

(56) References Cited

U.S. PATENT DOCUMENTS

| | | | | |
|---|---|---|---|---|
| 4,788,018 | A * | 11/1988 | Yamada et al. | 264/29.7 |
| 2008/0120889 | A1 * | 5/2008 | Bose et al. | 42/76.02 |

FOREIGN PATENT DOCUMENTS

| | | | | |
|---|---|---|---|---|
| EP | 564778 | A1 * | 10/1993 | C22C 33/02 |

* cited by examiner

*Primary Examiner* — Rebecca Lee

(57) ABSTRACT

This invention relates to power metallurgical material, production method and application thereof. A metallurgy powder material with pressure-proof & good compactness, satisfactory to the component content requirements for 316 stainless steel, wherein, 5~9% (by weight) of $Fe_3P$ (or $Fe_3PO_4$). The powder metallurgical material has properties of pressure resistance and corrosion resistance, and excellent compactness.

7 Claims, No Drawings

POWDER METALLURGICAL MATERIAL, PRODUCTION METHOD AND APPLICATION THEREOF

FIELD OF INVENTION

This invention relates to a powder metallurgy material with pressure-proof & good compactness, production method and application thereof. especially the metallurgy powder material, process and application, mainly applied to the adjusting block of automobile electronic fuel injection pump, and also other products with high requirements for corrosion resistance, residual magnetism, air tightness and surface hardness in motorcycle, gasoline engine and diesel engine, etc.

DESCRIPTION OF RELATED ARTS

Automobile electronic fuel injection pump is an important component to satisfy European IV environmental standard for automobile. Performance requirements for the adjusting block in automobile are high: HBW190-215 hardness, high corrosion resistance, residual magnetism not greater than 2 Gaussian, high density against leakage under 2 Mpa pressure. Wherefore many countries adopt high process technology and good materials in the adjusting block. For example, the 316 stainless steel ($0Cr_{17}Ni_{12}Mo_2$) is used for processing and manufacturing in the USA and Europe.

The adjusting block is normally obtained by mechanical machining, i.e.: An adjusting block has rectangular shape and inner bore, with 4 small via holes of about 4.5 m/m in four corners at required dimensions and positions, cut with oil grooves in front and back sides. There are two ears on the inner bore in the back side. There are certain requirements for dimensional tolerance and shape tolerance. As no magnetism is allowed to exist, it cannot be processed by using a plain surface grinder. In the initial stage, we use NC milling machine to work on the oil grooves and plane. To keep no magnetism, special rolling tools are used before machining. The working efficiency is as low as 10 parts per hour, at high costs. During rolling, the piece was very difficult to be held firmly, affecting final quality and performance.

The metallurgy powder techniques have been also introduced. For example: (1) Powder metallurgy is manufactured by using 304 stainless steel and graphite, in the process of mixing-pressing-sintering-trimming, at finished density of 6.6-6.9 g/cm$^3$ and hardness of HBW140-160. Thanks to the existence of carbon, the product has magnetism and is low in density, leaking under 2 MPa pressure, failed to meet the requirements. (2) 304 stainless steel powder sintering and copper cementation method, in the process of mixing-pressing-sintering-copper cementation-trimming. The product is greater than 7.3 g/cm$^3$ in finished density, no magnetism, about HBW 180 in hardness. No leakage under 2 MPa pressure. However, non-ferrous metal content reached about 12%. Copper cementation process needs die pressing, equivalent to second sintering, complicated in process and high in costs. (3) 304 stainless steel once pressing and sintering method, in the process of mixing-pressing-high temperature sintering-plastic impregnation-hardening-trimming. With density >6.9 g/cm$^3$ and hardness improved to HBW180-190, 1300-degrees Celsius high temperature sintering is effective to improve density and hardness. High temperature sintering is high in consumption of power, zirconia pads and graphite pads. So, the costs are high. In case of leaking, plastic impregnation has to be made. Therefore, all the existing preparation processes as mentioned above are defective and cannot fulfill the product performance requirements.

SUMMARY OF THE INVENTION

The invention is to provide technical solutions, one of which is: provide a kind of stainless steel powder metallurgy material high in pressure resistance, corrosion resistance, residual magnetism not greater than 2 Gaussian and excellent in compactness.

Secondly, the invention resolves the problem of insufficient hardness and density in the existing metallurgical powder techniques to prepare adjusting block within automobile electronic fuel injection pump. It provides a kind of new metallurgical powder technique to apply for adjusting block within automobile electronic fuel injection pump with high in hardness and density, no leakage and low residual magnetism.

Thirdly, the invention provides the application of the mentioned metallurgy powder material.

The invention provides powder metallurgy material with pressure-proof & good compactness, conforming to the component content requirements for the 316 stainless steel ($0Cr_{17}Ni_{12}Mo_2$). In the formulation, 5-9% of $Fe_3P$ is added in proportion to the weight.

Based on the above mentioned technical proposal, said fineness of 316 stainless steel powder is less than 100 mesh, and that of $Fe_3P$ powder is less than 325 mesh. The percentage of $Fe_3P$ powder by weight is 5%, 5.5%, 6.0%, 6.5%, 7.0%, 7.5%, 8.0%, 8.5% or 9.0%.

To reach the achievable result, the 316 stainless steel powder shall be finer than 100 mesh, and $Fe_3P$ powder shall be ultramicrofine modified ferric phosphate with the particle size finer than 325 mesh.

In the said 316 stainless steel, there are 10~14% of Ni with remanence of 2 Gaussian. The invention provides a method of producing the metallurgy powder material with pressure-proof & good compactness, following procedures shall be adopted:

(1) In atomized 316 stainless steel powder, add 5~9% of $Fe_3P$ or $Fe_3PO_4$ powder (by weight) for pre-processing, to prepare the base powder;

(2) Filling the press die with the base powder and press it into a parison by using a 200-ton automatic hydraulic press with a unit pressure of 7~9 tons/m$^2$, in a press die structure of 2 up and 3 down;

(3) Sintering the parison within a vacuum sintering furnace at 1050~1120° C. for 35~50 minutes in about 10 Pa vacuum;

(4) The sintered parison shall be level up, fluting and then, make them into the products;

The said step (1) shall include the following pre-processing steps:

1) Take ½ of the 316 stainless steel powder, premix it with 0.2% engine oil, and sieve it through a 60 mesh sieve;

2) Take ½ of the 316 stainless steel powder, premix it with 0.8% lubricant, and sieve it through a 80 mesh sieve;

3) Take 5%-9% of $Fe_3PO_4$ powder by total weight;

4) Put the powder processed in Steps 2), 3) and 4) into a powder mixer and mix for 1 hour, before sieving through a 80 mesh sieve.

Based on the mentioned technical proposal, the said 316 stainless steel powder is annealed at 450 to 470° C. for 60 minutes in 5~3×10 Pa vacuum. For example, annealing for 60 minutes at 450, 460, 470 or 450° C.

Based on the above mentioned technical proposal, the said lubricant is stearate or zinc stearate or magnesium stearate, using engine oil as adhesive to prevent vibration and powder segregation.

The application of metallurgy powder material with pressure-proof & good compactness is to prepare automobile electronic fuel injection pump adjusting block. The invention material can also be applied to other products with high requirements for corrosion resistance, little remanence, air pressurize and surface hardness in motorcycle, gasoline engine, diesel engine and others.

Adding a small amount of engine oil is to improve bonding between different components and prevent powder segregation under vibration during transport and pressing. Adding lubricant is to reduce friction between powder particles and press die wall and plunger, improve density distribution, reduce pressure loss and serve easy die release.

Based on mentioned technical proposal, the granular composition of 316 stainless steel powder consists of 25~30% of 100 to 200 mesh and 35~38% of less than 325. The others are 200 mesh to 325 mesh.

Based on the above, there are 10~14% of Ni in the said 316 stainless steel.

Based on the above, the content of Ni in the said 316 stainless steel is up to 12~14% with remanence less than 2 Gaussian.

Based on mentioned technical proposal, after compaction and before sintering, degreasing and chemical treatment at 450-470 degrees Celsius is carried out to the compacted billet for 60 minutes under 3×10-5 Pa vacuum. For example, degreasing and chemical treatment at 450, 460 or 470 degrees Celsius for 60 minutes.

Based on the above mentioned technical proposal, the said powder is sieved through 80 mesh sieve.

The remarkable technical advantages of the invention shall be reflected in that: (1) the produced adjusting block is fine in crystal grain, low in impurity and, therefore, high in product performance. Tests show that, the density of adjusting block can reach 7.45 g/cm$^3$ and hardness HBW222, good in air tightness at 2 MPa with remanence not greater than 2 Gaussian. (2) Simple process, easy to control, high in rate of finished products. (3) It applicable to both mass production and small batch manufacture, very flexible. (4) $Fe_3PO_4$ powder shall be ultramicrofine modified ferric phosphate, composed of $Fe_3P$, $Fe_2P$ and FeSi, whereas these materials are much lower than $Fe_xMo_y$. (5) The adjusting block of automobile electronic fuel injection pump is very high in precision. With strictly controlled granular size of 316 stainless steel powder, the 4 small holes, 1 center hole, groove and lug are high in dimensional precision, and so is the reference hole, fully satisfying the use demand. (6) owing to low sintering temperature, ⅓ of power consumption can be saved, with less sintering heating element and auxiliary materials, representing a good material for carbon and emission reduction. (7) All the world is looking for method to increase powder metallurgic density, generally through high speed shaping. The patent is to increase density by modifying materials and increasing sintering density.

DETAILED OF DESCRIPTION OF THE PREFERRED EMBODIMENT

Preferred Embodiment 1

The pressure-proof and high density 316 stainless steel ($0Cr_{17}Ni_{12}Mo_2$) metallurgy powder material, with component contents of 12% nickel powder, 17% chromium powder and 2% molybdenum powder. The percentage of $Fe_3P_4$ by weight is 5%, 5.5%, 6.0%, 6.5%, 7.0%, 7.5%, 8.0%, 8.5% or 9.0%. Carrying out pre-processing onto the above mentioned powder is to prepare 9 groups of base powder formula.

The 316 stainless steel powder shall be finer than 100 mesh, and $Fe_3PO_4$ powder shall be ultramicrofine modified ferric phosphate with the particle size mesh. The following steps are taken to prepare adjusting block of automobile electronic fuel injection pump by using the above mentioned 9 groups of formula:

The 316 stainless steel powder, 5~9% of $Fe_3P$ (or $Fe_3PO_4$) is added in proportion to the total weight;

The said Step (1) shall include the following pre-processing steps:

(1) In atomized 316 stainless steel powder, add 5~9% $Fe_3P$ (or $Fe_3PO_4$) powder (by weight) to prepare the base powder;

(2) Filling the press die with the mentioned base powder and press it into a parison by using a 200-ton automatic hydraulic press with a unit pressure of 7~9 tons/m$^2$, in a die structure of 2 up and 3 down;

(3) Sintering the parison within a vacuum sintering furnace at 1050~1120° C. for 35~50 minutes in about 10 Pa vacuum;

(4) The sintered parison shall be level up, fluting and then make them into the products;

The said Step (1) shall include the following pre-processing steps:

1) Take ½ of the 316 stainless steel powder, premix it with 0.2% engine oil, and sieve it through a 60 mesh sieve;

2) Take ½ of the 316 stainless steel powder, premix it with 0.8% lubricant, and sieve it through a 80 mesh sieve;

3) Take 5%-9% of $Fe_3PO_4$ powder by total weight;

4) Put the powder processed in Steps 1), 2) and 3) into a powder mixer and mix for 1 hour, before sieving through a 80 mesh sieve.

The said 316 stainless steel powder is annealed at 150~450° C. for 60 minutes in 3×10−5 Pa vacuum. For instance, annealing for 60 minutes at 150, 250, 330 or 450° C. The said lubricant is stearic acid or zinc stearate or magnesium stearate, using engine oil as adhesive to prevent vibration and powder segregation.

Adding a small amount of engine oil is to improve bonding between different components and prevent powder segregation under vibration during transport and pressing. Adding lubricant is to reduce friction between powder particles and press die wall and plunger, improve density distribution, reduce pressure loss and serve easy die release.

In this embodiment, the said 316 stainless steel powder is finer than 100 mesh and ferric phosphate ($Fe_3PO_4$) or $Fe_3P$ finer than 325 mesh.

The application of pressure-proof powder 1 with good compactness is to prepare automobile electronic fuel injection pump adjusting block. The invention materials can also be used for other products with high requirements for corrosion resistance, residual magnetism, air tightness and surface hardness in motorcycle, gasoline engine, diesel engine and others.

Preferred Embodiment 2

The pressure-proof and high density 316 stainless steel (0Cr17Ni12Mo2) metallurgy powder material, with component contents of 12% nickel powder, 17% chromium powder and 2% molybdenum powder. The percentage of $Fe_3P$ by weight is 5%, 5.5%, 6.0%, 6.5%, 7.0%, 7.5%, 8.0%, 8.5% or 9.0%. Pre-treatment is carry out to the above mentioned powder to make 9 groups of base powder formula.

The 316 stainless steel powder shall be finer than 100 mesh, and $Fe_3P$ powder shall be ultramicrofine modified ferric phosphate with the particle size ≤325 mesh.

The following steps are taken to prepare automobile electronic fuel injection pump adjusting block by using the above mentioned 9 groups of formula:

The 316 stainless steel powder, is added 5~9% $Fe_3P$ in proportion to total weight;

The said Step (1) shall include the following pre-treatment steps:

(1) In atomized 316 stainless steel powder, add 5-9% of $Fe_3PO_4$ powder (by weight) to prepare the base powder;

(2) Filling the press die with the above mentioned base powder and press it into a parison by using a 200-ton automatic hydraulic press with a unit pressure of 7~9 tons/$cm^2$, in a die structure of 2 up and 3 down;

(3) Sintering the parison within a vacuum sintering furnace at 1050~1120° C. for 35~50 minutes in about 10 Pa vacuum;

(4) The sintered parison pressed compact, cut grooves and make them into the products;

The said Step (1) shall include the following pre-processing steps:

1) Take ½ of the 316 stainless steel powder, premix it with 0.2% engine oil, and sieve it through a 60 mesh sieve;

2) Take ½ of the 316 stainless steel powder, premix it with 0.8% lubricant, and sieve it through a 80 mesh sieve;

3) Take 5%-9% of $Fe_3PO_4$ powder by total weight;

4) Put the powder processed in Steps 1), 2) and 3) into a powder mixer and mix for 1 hour, before sieving through a 80 mesh sieve.

The said lubricant is stearic acid or zinc stearate or magnesium stearate, using engine oil as adhesive to prevent vibration and powder segregation.

Adding a small amount of engine oil is to improve bonding between different components and prevent powder segregation under vibration during transport and pressing. Adding lubricant is to reduce friction between powder particles and press die wall and plunger, improve density distribution, reduce pressure loss and serve easy die release.

In the embodiment, the said 316 stainless steel powder is finer than 100 mesh. The ultramicrofine modified ferric phosphate is finer than 325 mesh.

The application of pressure-proof powder metallurgy material with good compactness is to prepare automobile electronic fuel injection pump adjusting block. The invention material can also be used for other products with high requirements for corrosion resistance, residual magnetism, air tightness and surface hardness in motorcycle, gasoline engine, diesel engine and others.

In the embodiment, the granular composition of stainless steel 316 powder consists of 25-30% of 100 to 200 mesh and 35-38% of less than 325. Others are 200 mesh to 325 mesh.

In the embodiment, there are 12% of Ni in the said 316 stainless steel with remanence ≤2 Gaussian.

Between after compaction and before sintering, degreasing and chemical treatment at 450~470° C. is carried out to the compacted billet for 60 minutes under 3×10−5 Pa vacuum. For example, degreasing and chemical treatment at 450, 460 or 470° C. for 60 minutes.

The invention claimed is:

1. A method for producing a product with a stainless steel powder bearing a chemical formula of $Cr_{17}Ni_{12}Mo_2$, said method comprising:

adding in said stainless steel powder a 5-9% $Fe_3P$ powder by weight for pre-processing into a basic powder;

pressing the basic powder under a pressure of 7-9 tons/$m^2$ into a pressed material;

sintering the pressed material in a vacuum sintering furnace at 1050-1120° C. for 35-50 minutes in about 10 Pa vacuum into a sintered pressed material; and fluting the sintered pressed material for obtaining the product.

2. The method according to claim 1, wherein said adding comprises:

premixing approximately 50 percent of said stainless steel powder with 0.2% engine oil, and sieving the mixture through a 60 mesh sieve for providing a first mixture;

premixing approximately remaining amount of said stainless steel powder with 0.8% lubricant, and sieving the mixture through a 80 mesh sieve for providing a second mixture;

mixing 5-9% of $Fe_3P$ powder by total weight with the first mixture and the second mixture for one hour for providing a third mixture; and sieving the third mixture through an 80 mesh sieve.

3. The method according to claim 2, wherein the lubricant comprises one of stearic acid, zinc stearate and magnesium stearate.

4. The method according to claim 1, further comprising annealing said pressed material at 150~450° C. for 60 minutes in 5~30 Pa vacuum prior to said sintering.

5. The method according to claim 1, wherein said stainless steel powder comprises a particle size of 25%~30% of 100 to 200 mesh, 35~38% less than 325 mesh, and remaining amount of 200~325 mesh.

6. The method according to claim 1, wherein said stainless steel powder comprises 10~14% Ni.

7. The method according to claim 1, wherein said stainless steel powder comprises 12-14% Ni with less than 2 Gs effective remanence.

* * * * *